US007878380B2

(12) United States Patent
Bass

(10) Patent No.: US 7,878,380 B2
(45) Date of Patent: Feb. 1, 2011

(54) PORTABLE CARRYING DEVICE

(76) Inventor: John Bass, 3635-E SW. Natura Ave., Deerfield Beach, FL (US) 33441

( * ) Notice: Subject to any disclaimer, the term of this patent is extended or adjusted under 35 U.S.C. 154(b) by 224 days.

(21) Appl. No.: 11/943,965

(22) Filed: Nov. 21, 2007

(65) Prior Publication Data

US 2009/0127303 A1 May 21, 2009

(51) Int. Cl.
*A45F 5/00* (2006.01)

(52) U.S. Cl. ..... 224/600; 224/254; 224/257; 224/258; 224/925

(58) Field of Classification Search ..... 224/103, 224/150, 250, 254, 258, 600, 257, 925; 294/150, 294/137, 141, 145, 149, 152, 164, 165, 167, 294/170

See application file for complete search history.

(56) References Cited

U.S. PATENT DOCUMENTS

| | | | | | |
|---|---|---|---|---|---|
| 432,539 | A | | 7/1890 | Mains | |
| 2,784,519 | A | | 3/1957 | Ralston et al. | |
| 3,002,780 | A | * | 10/1961 | Eggeman | 294/74 |
| 3,307,870 | A | * | 3/1967 | Archer | 294/74 |
| 3,957,237 | A | | 5/1976 | Campbell | |
| 4,311,288 | A | | 1/1982 | Galland | |
| 4,392,680 | A | * | 7/1983 | Wolfe | 294/82.11 |
| 4,414,712 | A | | 11/1983 | Beggins | |
| 4,604,773 | A | | 8/1986 | Weber et al. | |
| 4,665,590 | A | | 5/1987 | Udelhofen et al. | |
| 4,881,706 | A | | 11/1989 | Sedlik | |
| 4,896,403 | A | | 1/1990 | Vouros | |
| 4,982,522 | A | | 1/1991 | Norton | |
| 4,998,694 | A | | 3/1991 | Barteaux | |
| 5,294,029 | A | | 3/1994 | Shimura et al. | |
| 5,345,656 | A | | 9/1994 | Merritt | |
| 5,379,494 | A | | 1/1995 | Shirakawa | |
| 5,464,102 | A | | 11/1995 | LeBlanc et al. | |
| 5,465,466 | A | | 11/1995 | Napier | |
| 5,517,729 | A | * | 5/1996 | Shaffer | 24/30.5 R |
| 5,615,811 | A | | 4/1997 | Bell et al. | |
| 5,655,272 | A | | 8/1997 | Young | |
| 5,784,747 | A | | 7/1998 | Girardot et al. | |
| D400,087 | S | | 10/1998 | Hartmann et al. | |
| 5,855,403 | A | | 1/1999 | Harper | |
| 5,896,623 | A | | 4/1999 | Martin | |
| 5,897,039 | A | | 4/1999 | Swenke | |

(Continued)

*Primary Examiner*—Nathan J Newhouse
*Assistant Examiner*—Adam Waggenspack
(74) *Attorney, Agent, or Firm*—Fox Rothschild, LLP; Robert J. Sacco

(57) ABSTRACT

The invention relates to a portable carrying device, arrangement, and method for carrying at least one object such as a bag. The device 100 includes a housing 101 having a channel 105 defined therethrough. The channel 105 is further defined by a first and a second frusto-shaped internal cavity 107, 109, each having linearly tapered sides 110. An elongated flexible strap 103 defining a continuous loop 103 is threaded through the channel 105. Portions of the elongated flexible strap 103 defining the continuous loop extend from first and second end openings 117, 115 of the channel 105 to define first and a second loop portions 119, 121. When the continuous loop is pulled taut through the housing 101, the first loop portion 119 is configured for receiving and grasping a handle portion 201 of the one or more bags 203. The second loop portion 121 can be extended over and around a user's shoulder for carrying the device 100 and the one or more bags 203.

7 Claims, 5 Drawing Sheets

U.S. PATENT DOCUMENTS

| | | | |
|---|---|---|---|
| 5,971,458 | A | 10/1999 | Contreras et al. |
| 5,983,881 | A | 11/1999 | Killian |
| 5,987,712 | A | 11/1999 | Tucker |
| 6,182,672 | B1 | 2/2001 | Abasta-Douglas et al. |
| 6,185,798 | B1 | 2/2001 | Ton |
| 6,336,576 | B1 | 1/2002 | Easter |
| 6,378,937 | B1 | 4/2002 | Faudman |
| 6,381,816 | B1 | 5/2002 | Lai et al. |
| 6,447,037 | B1 | 9/2002 | Crouch |
| 6,749,099 | B2 | 6/2004 | Danielson |
| 6,824,182 | B2 | 11/2004 | Graham |
| 2006/0011682 | A1 * | 1/2006 | Christensen et al. ..... 224/274 |

* cited by examiner

PORTABLE CARRYING DEVICE

BACKGROUND OF THE INVENTION

1. Statement of the Technical Field

The inventive arrangements relates generally to the field of portable carrying devices, and more particularly to portable bag carrying devices.

2. Description of the Related Art

Individuals commonly need to carry a variety of objects; however, there is a limit to how many objects that can be comfortably grasped with an individual's hands. To overcome this limit, many devices have been constructed to increase the number of objects that an individual can carry. Suitcases have been designed for orderly storing of multiple items. However, suitcases are usually bulky and not convenient for toting along on a daily basis. As another example, backpacks allow an individual to store multiple items on the individual's back and leave the hands free for grasping other items. While back packs offer one solution, they also create another problem similar to other attempted solutions. The individual must carry the bulky backpack prior to use, and similar to suitcases, backpacks may not be convenient for toting along on a daily basis. Additionally, backpacks of any useful size cannot easily be stored as most backpacks are not configured to fold into a compact unit.

Traditional brown paper bags allow shoppers to carry multiple items, from a grocery store for example, without having to hold each item individually with the shopper's hands. Additionally, brown paper bags are easily folded into a compact state that allows easy storage. While brown paper bags can be easily stored and can ease the burden of carrying multiple items, a common disadvantage of brown paper bags is that they require a shopper to use both hands and arms to securely support the brown paper bag.

An improvement over the traditional brown paper bag is a plastic bag with integrated handles. Such plastic bags allow individuals to comfortably carry multiple items within the bag by using only the hand to grasp the handles. Plastic bags are either easily stored or simply thrown away. Nevertheless, plastic bags with handles still have limitations. For example, while a lightweight plastic bag can be easy to carry by hand, carrying a heavy plastic bag by hand can be uncomfortable and even painful. The weight of the bag can cause the bag's handles to apply a significant amount of pressure to the individual's hand. This problem is greatly exacerbated when the individual is attempting to carry multiple bags of any significant weight. The discomfort and/or pain caused by the weight of the bags only increases with the amount of time the bags must be carried. Thus, using a plastic bag to carry a heavy weight over a long period of time is not a viable option.

Additionally, while carrying heavy bags by hand may cause discomfort or pain to some individuals, other individuals simply do not have the strength to carry items by hand. For instance, many elder individuals have a decreased strength and cannot carry items that are a routine part of the life, such as shopping or grocery store bags. Further, some individuals cannot carry certain items because of a handicap or deformity. Nevertheless, such individuals in particular, need to be able to carry such items in order to remain independent from constant help. Thus, a portable device that is easily compacted for storage and that can be used to carry multiple items is desired.

SUMMARY OF THE INVENTION

The present invention is directed to a device, system, and method for carrying at least one object such as a bag. The device includes a housing comprising a channel. The channel includes a first frusto-shaped internal cavity and a second frustro-shaped internal cavity. Moreover, the first and second cavities include linearly tapered sides. The device includes an elongated flexible strap defining a continuous loop disposed within the channel and the first and second frusto-shaped internal cavities. Portions of the elongated flexible strap defining the continuous loop extend from first and second end openings of the channel defining a first loop portion and a second loop portion. The first loop portion is configured for receiving and grasping a neck portion of one or more bags when the continuous loop is pulled through the channel.

There are several optional features of the device. For example, the first and second cavities are sized and shaped to fit a neck portion of one or more bags. Another feature is that the second loop portion is configured for use as a shoulder strap. Also, the device includes a member, such as a bolt, for securing the continuous loop to the housing.

In an alternative embodiment of the invention, the device is used for grasping and carrying an article having a substantially u-shaped handle such as a briefcase or luggage case. For example, the article is a briefcase having a u-shaped handle. In use, first loop portion is pulled from within the first end opening of the channel. The first loop portion is threaded through the handle of the briefcase. The apex or end of the first loop portion is inserted into a hook disposed one side of the housing of the device. The end of the first loop portion is pulled taught against the hook by pulling the second loop portion through the channel in the housing. Alternately, the hook is used to carry an article in addition to at least one bag carried threaded through the continuous loop with the device.

The invention also relates to an arrangement of at least one bag in combination with a system for carrying these bag(s). The arrangement comprises one or more bags. Also the arrangement includes a housing comprising a channel having a first internal cavity and a second internal cavity. The first and second internal cavities are configured such that they abut adjacent the second internal cavity. An elongated flexible strap defining a continuous loop is disposed within the channel and the first and second internal cavities. Portions of the elongated flexible strap extend from first and second end openings of the channel defining a first loop portion and a second loop portion. To secure the bag(s) for carrying, the first loop portion is configured for receiving and grasping a neck portion of the bag(s) when the continuous loop is pulled through the channel.

The invention also is directed to a method for carrying one or more bags. The method includes the step of forming a housing having a first frusto-shaped internal cavity and a second frusto-shaped internal cavity. The first and second cavities are shaped such that they have linearly tapered sides. The method includes the step of disposing an elongated flexible strap defining a continuous loop through a first end opening and a second end opening of the housing. Portions of the elongated flexible strap defining the continuous loop extend from the first and second end openings of the channel defining a first loop portion and a second loop portion. The method includes the step of threading a neck portion of at least one bag through the first loop portion. The method includes the step of pulling the second loop portion taut, causing the first loop portion to grasp the neck portion. The neck portion is drawn into the first frusto-shaped internal cavity and held securely therein.

As an alternative feature to the above method, the continuous loop is secured to the housing by disposing a bolt through the continuous loop and within one of the first and second frusto-shaped internal cavities. In addition, the first frusto-shaped internal cavity is sized such that it is larger than the second frusto-shaped internal cavity. Moreover, the first and second internal cavities are configured such that a first truncated plane of the first frusto-shaped internal cavity abuts adjacent to a second truncated plane of the second frusto-shaped internal cavity.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

The present invention concerns a portable carrying device that can be used to carry multiple objects. In particular, the portable carrying device can be used for carrying multiple objects such as bags with handles. Advantageously, the portable carrying device can be used to carry multiple objects such as bags while leaving the user's hands free for other tasks.

Figure 1A:
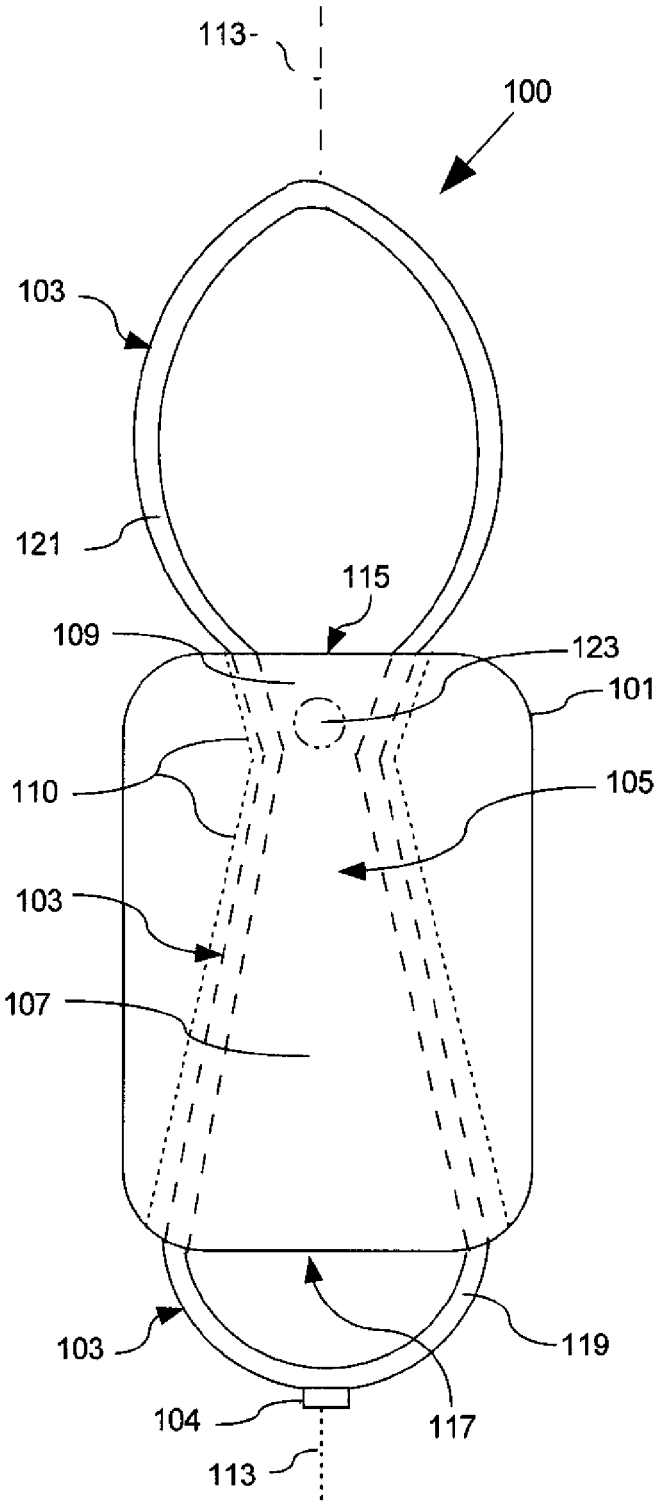
FIG. 1A shows a front view of a portable carrying device that is useful for understanding the invention.
Figure 1B:
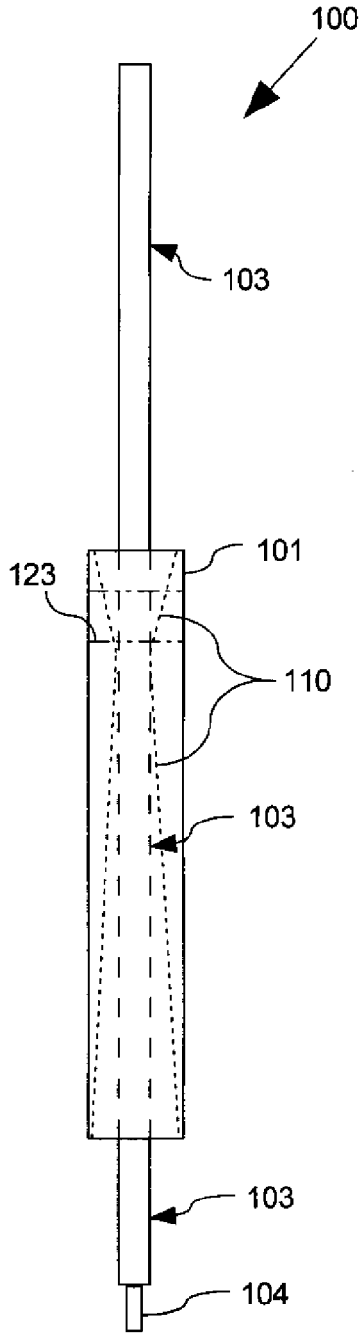
FIG. 1B shows a side view of the device of FIG. 1A with the opposite side being a mirror thereof.

Referring to FIGS. 1A and 1B, show are respective front and side views of one embodiment of a portable carrying device 100. The device 100 includes a housing 101 and an elongated flexible strap 103 which is threaded through a channel 105 formed through the housing 101. The housing 101 can be of generally parallelepiped shape. However, one skilled in the art will recognize that the shape of the housing 101 is not limited to the embodiment shown. The shape of the housing 101 can include other shapes, such as spherical, oval, and oblong. Additionally, the housing 101 can be constructed of a hard plastic, metal, ceramic, or any other suitable material known to one of ordinary skill in the art.

The elongated flexible strap 103 defines a continuous loop so that a first loop portion 119 extends from a first end opening 117 of channel 105 of housing 101 and a second loop portion 121 extends from a second end opening 115 of channel 105 of housing 101. The first loop portion 119 could include a pull tab 104 disposed at the apex of the loop portion 119. The pull tab 104 is useful for grasping loop portion 119 for pulling loop portion 119 from within channel 105 through first end opening 117 as described below. The elongated flexible strap 103 can be constructed of any flexible material suitable for supporting objects such as webbed/braided fabric, neoprene, leather, and the like known to one of ordinary skill in the art.

The first loop portion 119 can be used for grasping one or more objects such as the handle or neck of a bag such as a grocery bag. After the one or more objects or bags have been grasped, the continuous loop 103 is pulled through the channel 105 of housing 101 by grasping and pulling the second loop portion 121. This causes first loop portion 119 to be pulled taut into the first end opening 117 of channel 105 of housing 101. The second loop portion 121 can now be used to carry the device 100 and the one or more objects. For example, the second loop portion 121 can be extended over or around the user's shoulder. Thus, the entire weight of the portable carrying device 100 and the one or more objects is supported by the user's shoulders, allowing the user to comfortably carry the one or more objects while having the hands free to grasp other objects. The operation of the elongated flexible strap 103 and housing 101 is discussed further hereinbelow.

The channel 105 defined in housing 101 can be formed along a longitudinal axis 113, from the second end opening 115 to the first end opening 117. The channel 105 can include a first frusto-shaped portion 107 and a second frusto-shaped portion 109. As used herein, the term frusto-shaped means a cavity having tapered sides extending between two opposing truncated planes. Both the first and second frusto-shaped portions 107, 109 of channel 105 can have linearly tapered sides 110. According to the embodiment shown in FIG. 1A, the first frusto-shaped portion 107 can abut adjacent the second frusto-shaped portion 109 along each of their truncated planes. Moreover, the first frusto-shaped portion 107 can be larger than the second frusto-shaped portion 109.

Figure 2:
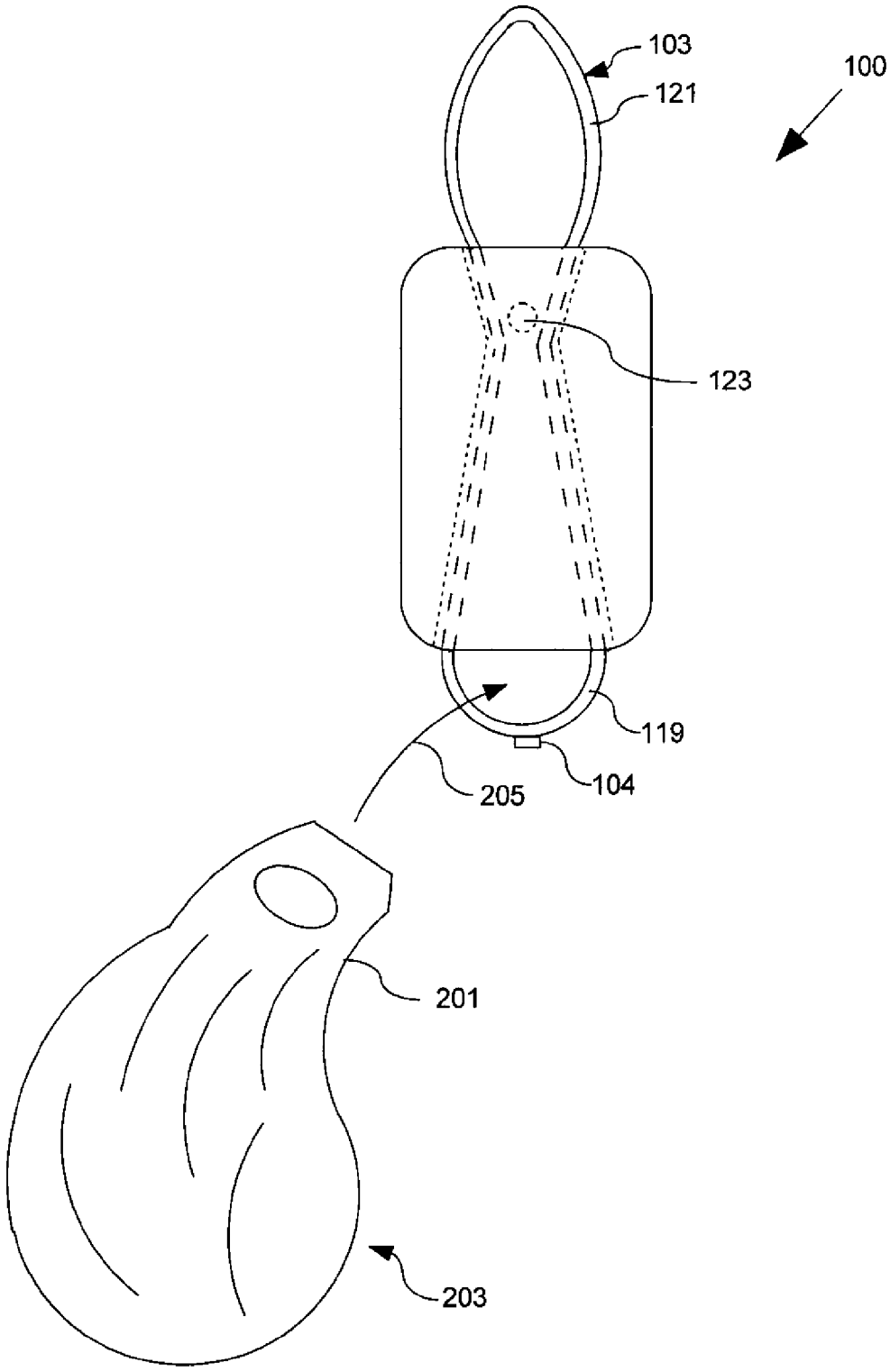
FIG. 2 shows a front view of the device of FIG. 1A showing the insertion of the neck of a bag in a first loop portion of an elongated flexible strap.

The elongated flexible strap 103 can be disposed within the channel 105, which includes the first and second frusto-shaped internal cavities 107, 109. Referring now to FIG. 2, the first loop portion 119 is configured for receiving a handle or neck portion 201 of at least one bag 203. Any bag shape can be used as long as the bag has a handle or flexible neck portion 201 that can be threaded through the first loop 119 portion, as indicated by the direction of arrow 205.

Figure 3:
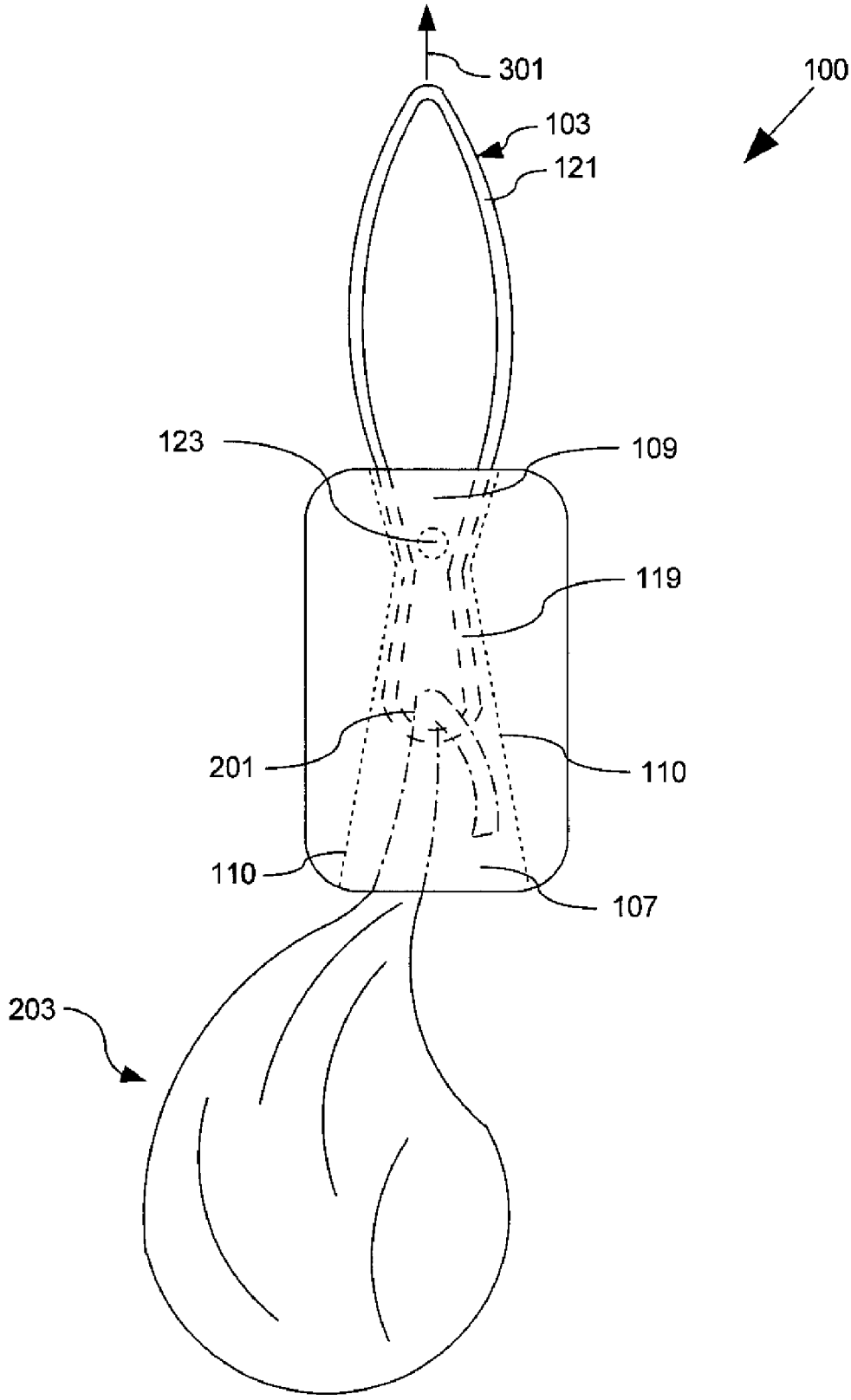
FIG. 3 shows another front view similar to FIG. 2 of the device of FIG. 1A showing the neck of the bag being grasped by the first loop portion of the elongated flexible strap and the first loop portion being pulled taut into a first frusto-shaped portion of a channel defined in the housing forming the device.

Referring now to FIG. 3, when the second loop portion 121 is pulled taut in the direction of arrow 301, the first loop portion 119 grasps the handle or neck portion(s) 201 of at least one bag 203, causing the neck portion(s) 201 and the first loop portion 119 to be pulled into the first frusto-shaped internal cavity 107 and held securely therein. The term "grasping" can mean firmly holding/gripping, engaging, or frictionally engaging. Since the neck portion 201 and first loop portion 119 can be pulled into the cavity 107, one of the first frusto-shaped internal cavity 107 and second frustro-shaped internal cavity 109 must be sized and shaped to receive the neck portion 201 and first loop portion 119.

As the neck portion 201 is pulled into the first cavity 107 by a pulling force in the direction of arrow 301, the frictional forces between the neck portion 201, the first loop portion 119, and the linearly tapered sides 110 of the first cavity 107 serves to wedge the neck portion 201 securely for carrying. The linearly tapered sides 110 offer a greater wedging effectiveness as compared to other types of cavity side configurations, such as curved tapered sides. Moreover, the bag 203 is maintained securely within the device 100 because the above frictional force is counterbalanced by the gravitational weight force acting on the bag 203.

According to the embodiment of the device 100 illustrated in FIGS. 1A, 2, and 3, the device 100 can include a member 123 for securing the elongated flexible strap 103 onto the housing 101. In particular, the member 123 can be a bolt. The bolt can be disposed through the continuous loop 103 and coupled to the housing 101 within the second frusto-shaped internal cavity 109. According to one alternative embodiment, the bolt can be removable in the event the elongated flexible strap 103 may need repair or replacement. The bolt can be constructed of the same materials discussed previously with respect to the housing 101.

Figure 4:
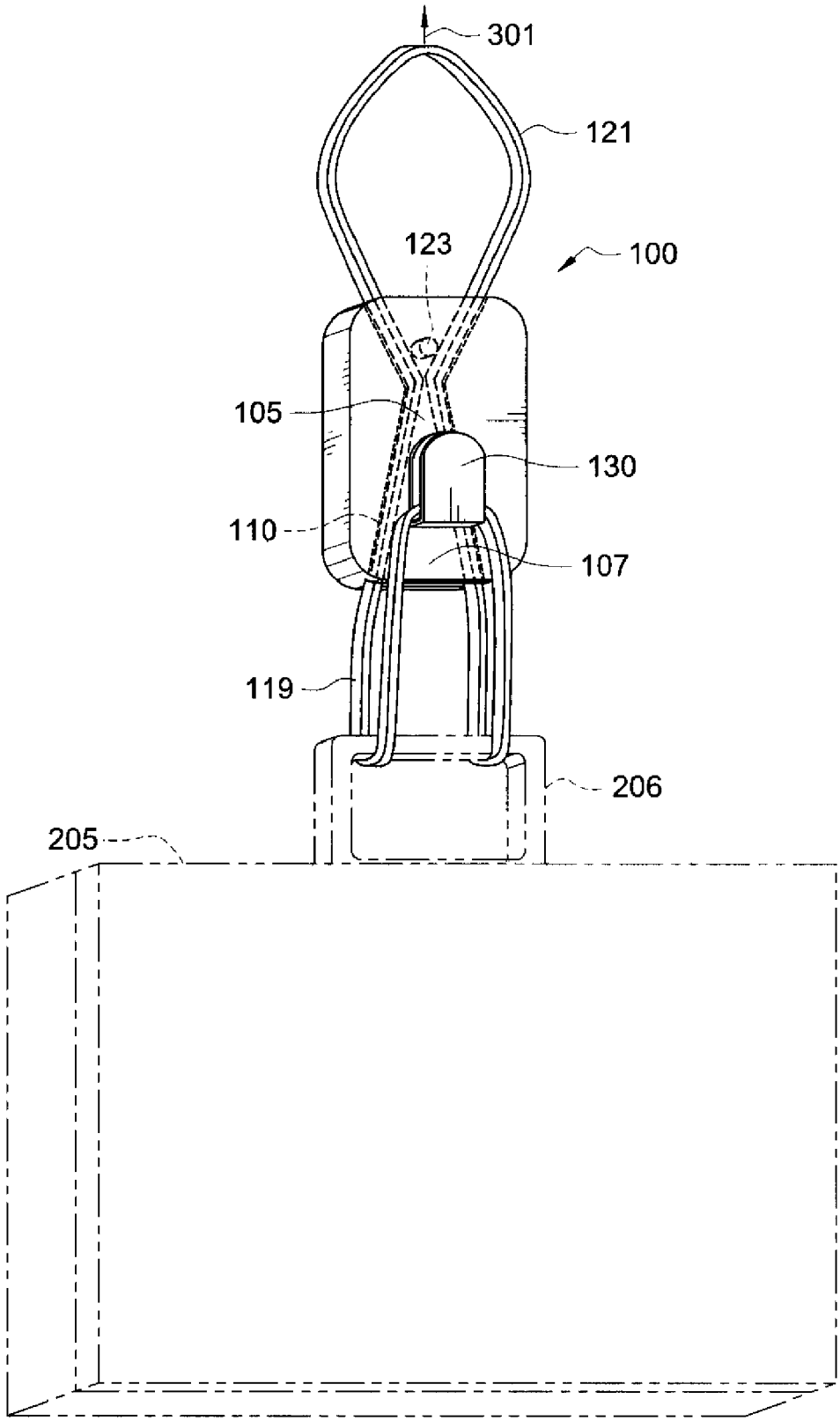
FIG. 4 shows another front view of the device of FIG. 1A showing the handle of briefcase being grasped by the first loop portion of the elongated strap and the first loop portion engaging a hook disposed on one side of the housing of the device.

Referring now to FIG. 4, shown is another embodiment of the device 100 used for grasping and carrying an article having a substantially u-shaped handle such as a briefcase or luggage case. In the embodiment shown in FIG. 4, the article 205 is a briefcase having a u-shaped handle 206 (shown in phantom). However, the invention is not limited in this regard as the article could be any article known to one of ordinary skill in the art desired to be carried with the device 100.

In use, the first loop portion 119 of continuous loop 103 is pulled from within the first frusto-shaped internal cavity 107 of channel 105. The first loop portion 119 is threaded through the handle 206 of the briefcase 205. The end of first loop portion 119 is inserted onto a hook 130 disposed on one side of the housing 101. The second loop portion 121 is pulled taut in the direction of arrow 301. This causes the continuous loop 103 to be pulled through the channel 105 of housing 101. This further causes the first loop portion 119 to be pulled into the first frusto-shaped internal cavity 107 of channel 105. The end of the first loop portion 119 is pulled taught against hook 130 and the u-shaped handle 206 of the briefcase. The second loop portion 121 can now be used to carry the device 100 and the briefcase 205 or other article.

To release the briefcase 205 from the device 100, the first loop portion 119 is pulled from within the first frusto-shaped internal cavity 107. This provides enough slack in first loop portion 119 so that first loop portion 119 can be disengaged from hook 130. Once first loop portion 119 is disengaged from hook 130, first loop portion 119 can be pulled from within the u-shaped handle 206 of briefcase 205.

Alternately, the device 150 could be used as described in FIGS. 1A, 1B, 2 and 3 for grasping a handle or neck portion 201 of at least one bag 203. In addition, other articles could be attached to the device 100 by hanging the articles on hook 130. For example, other articles such as additional bags could be attached to the device 100 by looping the handle over hook 130. This allows the device 100 to carry at least one bag by grasping the bag with the first loop portion 119 of continuous loop 103 and by securing additional articles to hook 130.

Figure 5:
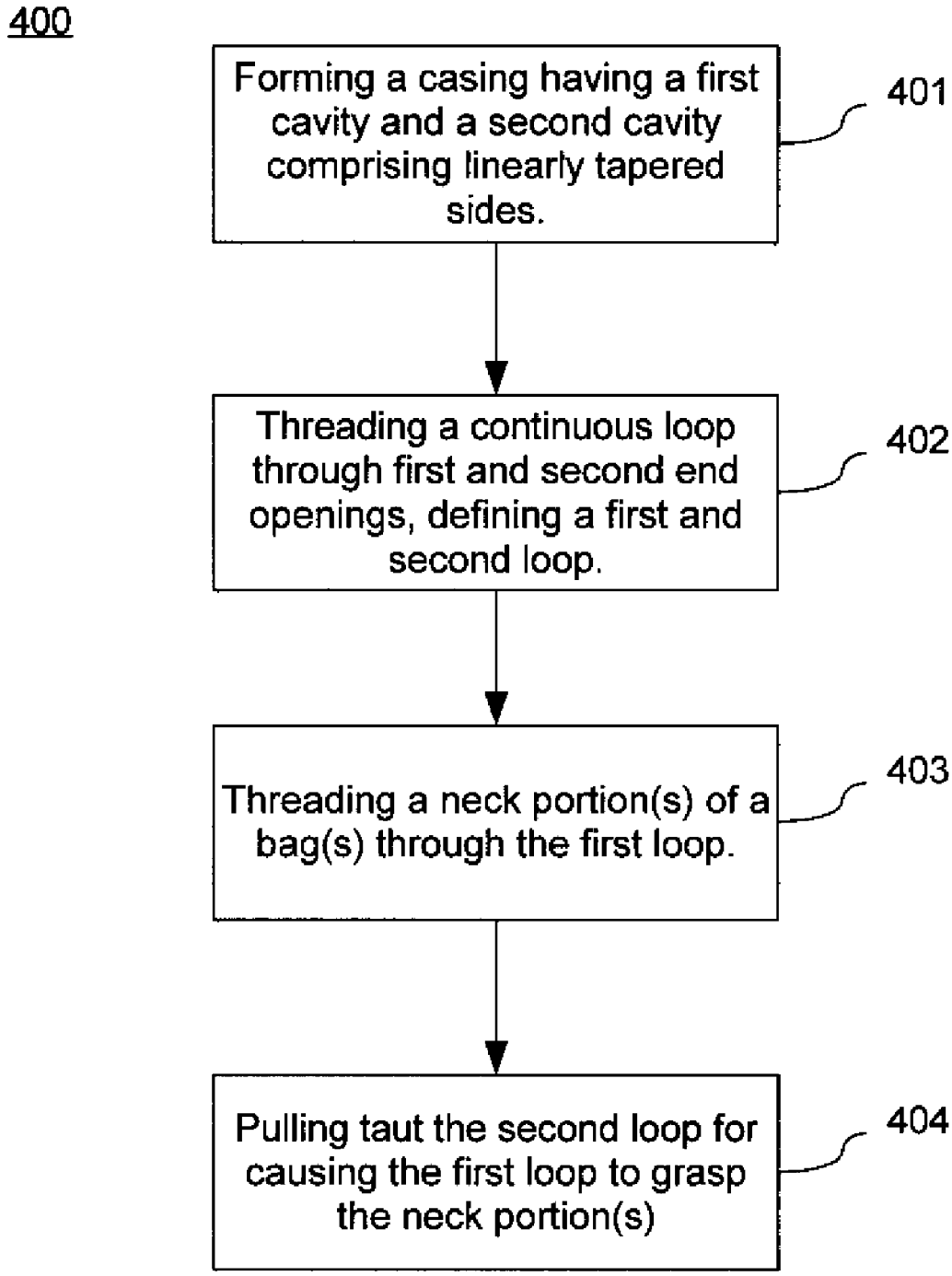
FIG. 5 shows a block diagram of a method for carrying at least one bag using the device of FIG. 1A.

Referring now to FIG. 5, a block diagram of the method 400 for carrying one or more objects such as bags is shown. In step 401, a housing can be formed comprising a first frusto-shaped internal cavity and a second frustro-shaped internal cavity. Furthermore, the first and second frusto-shaped internal cavity can be comprised of linearly tapered sides. In step 402, an elongated flexible strap defining a continuous loop can be threaded through a first end opening and a second end opening of the housing, defining a first loop portion and a second loop portion. In step 403, a neck portion of at least one bag can be threaded through the first loop portion. In step 404, the second loop portion can be pulled taut, causing the first loop portion to grasp the neck portion. This draws the neck portion into the first frusto-shaped internal cavity.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An apparatus for carrying at least one bag, comprising:

a housing comprising a channel having a first frusto-shaped internal cavity extending from a first end plane of said housing to a second frusto-shaped internal cavity extending from a second end plane of said housing, said first and second frustro-shaped internal cavities comprising sides that are linearly tapered inwardly toward an axis of said housing along a direction respectively extending away from a first end opening at said first end plane and a second end opening at said second end plane, said first end opening of said first frusto-shaped internal cavity substantially larger than said second end opening of said second frusto-shaped internal cavity;

a securing member disposed at a location closer to said second end opening than said first end opening, said securing member projecting into said channel from at least one of said sides in a direction transverse to said axis and configured for securing said strap within said housing;

an elongated flexible strap defining a continuous loop disposed within said channel and said first and second frusto-shaped internal cavities, defining a first loop portion and a second loop portion; and wherein said first loop portion is configured for receiving and grasping a handle portion of said at least one bag in said first frusto-shaped internal cavity when said continuous loop is pulled through said channel.

2. The apparatus for carrying at least one bag according to claim 1, wherein said second loop portion is configured for use as a shoulder strap.

3. The apparatus for carrying at least one bag according to claim 1, further comprising a pull tab disposed at an apex of said first loop portion.

4. The apparatus for carrying at least one bag according to claim 1, wherein one of said first and second frusto-shaped internal cavities is sized and shaped to receive a handle portion of said at least one bag.

5. The apparatus for carrying at least one bag according to claim 1, wherein a first truncated plane of said first frusto-shaped internal cavity abuts adjacent to a second truncated plane of said second frusto-shaped internal cavity.

6. The apparatus of claim 1, wherein said handle portion is substantially u-shaped and said housing includes a hook disposed on one side of said housing, said hook being configured for receiving an end of said first loop portion after said first loop portion has been threaded through said handle portion to grasp said handle portion when said continuous loop is pulled through said channel.

7. The apparatus of claim 1, wherein said housing includes a hook disposed on one side of said housing, said hook being configured for securing at least one other article to said housing for carrying said article in addition to at least one bag with the apparatus.

* * * * *